United States Patent [19]

Bond

[11] 4,074,376

[45] Feb. 21, 1978

[54] CONTOURED SECURITY PILLOW

[76] Inventor: Helen Inez Bond, 19416 Northeast Ave., Battle Ground, Wash. 98604

[21] Appl. No.: 782,619

[22] Filed: Mar. 30, 1977

[51] Int. Cl.[2] ..... A47G 9/00

[52] U.S. Cl. ..... 5/338

[58] Field of Search ..... 5/337, 338, 341, 50.56 N, 5/50.54 T, 50.52 R

[56] References Cited

U.S. PATENT DOCUMENTS

| | | | |
|---|---|---|---|
| 2,700,779 | 2/1955 | Tolkowsky | 5/338 |
| 2,940,088 | 6/1960 | Boos | 5/338 |

FOREIGN PATENT DOCUMENTS

| | | | |
|---|---|---|---|
| 610,415 | 10/1948 | United Kingdom | 5/338 |

*Primary Examiner*—Peter M. Caun

*Attorney, Agent, or Firm*—George R. Nimmer

[57] ABSTRACT

Disclosed are resiliently compressible pillows adapted to support a temple and a facial cheek of one of the symmetrical sides of a person's head who is reclining hemiside upon one upper-arm against a sleeping bed or other horizontal reclining surface. Noteworthy pillow contours include a facerest, a longitudinal channel to accommodate the person's shoulder and including a chin-restraint at the channel leading-end on the pillow front-wing, and a pillow frontal contoured cutaway to leave the subject's frontal vision unobstructed and also adapted to removably accommodate a pan accessory for collecting nasal and oral fluids. Other pillow features might include a dual-channels and symmetrical embodiment whereby the user might recline hemiside against his left or his right upper-arm, and an endward-recess adapted to removably accommodate the vanguard of a backrest accessory.

11 Claims, 8 Drawing Figures

CONTOURED SECURITY PILLOW

There are three basic reclining positions, namely, prone, supine, and hemiside i.e. wherein the person rests upon one of his upper-arms and with a single temple and facial cheek of the head downward. It is well known that the hemiside reclining position is better than prone or supine for certain maladies. For example, the hemiside position is known to reduce snoring during sleep, to enhance the drainage of nasal and sinus fluids of respiratory infections and congestion, to facilitate breathing of sleeping geriatric patients, to lessen likelihood of vomit strangulation, and to relieve inimical pressure upon patients suffering from anterior or posterior traumatic injury.

Pillows for stably securing or supporting the head, neck, shoulders, and other upper anatomy of reclining persons are taught in the prior art including, inter alia, U.S. Pat. Nos. 2,782,427(Ericson-2/26/1957), 3,604,023(Lynch-9/14/1971), and 3,694,831(Treace-10/3/1972). However, certain prior art structures do not reliably support the user in a truly hemiside reclining position, others are of a cumbersome construction, still others do not satisfactorily resist the person's tendencies to twist or roll upon the bed or other reclining surface, and others do not reliably maintain the person's head upon one only of its symmetrical sides for required therapeutic purposes.

It is accordingly the general object of the present invention to provide contoured security pillows that will reliably and comfortably maintain the user in a hemiside reclining position and including too the ensurance that the person's head will stably rest upon but one facial side with a single cheek and temple downwardly thereagainst, thereby affording therapeutic or other physical benefit to the pillow user.

With the above and other related objects and advantages in view, which will become more apparent as this description proceeds, the contoured security pillow of the present invention comprises a lofty resiliently compressible pad having the following primary contours: a depending central facerest including a higher elevation rear-contour portion sloping gently downwardly toward a front-contour portion for the user's facial cheek, at least one longitudinal channel to accommodate the user's shoulder and termining at the facerest and thereat including an upright chin-restraint, and a frontal cutaway portion which frees the user's forward vision and into which a pan for collecting nasal and oral drainage might be removably secured, together with other permissible contours such as a dual-channels style for permitting hemiside reclining against the left or the right upper-arm, an endward-recess adapted to removably accommodate the vanguard of a backrest accessory, and specially designed frontal and other contours.

In the drawing, wherein like characters refer to like parts in the several views, and in which.

Figure 1:
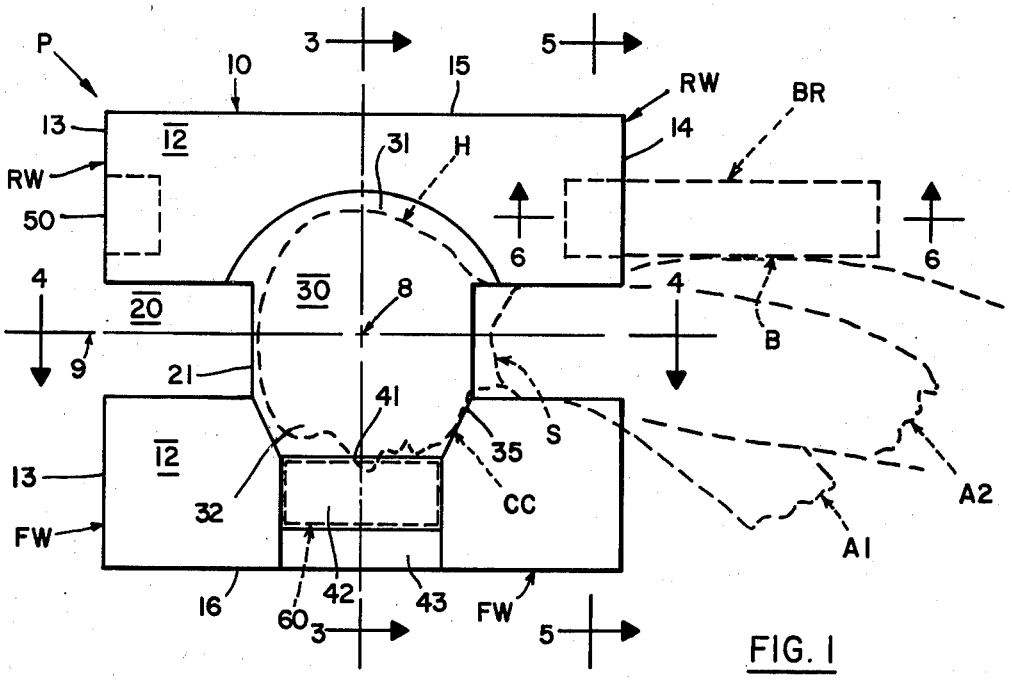
FIG. 1 is a top plan view of a representative embodiment of the security pillow of the present invention, the top plan view of a hemiside reclining user being indicated in phantom line.
Figure 2:
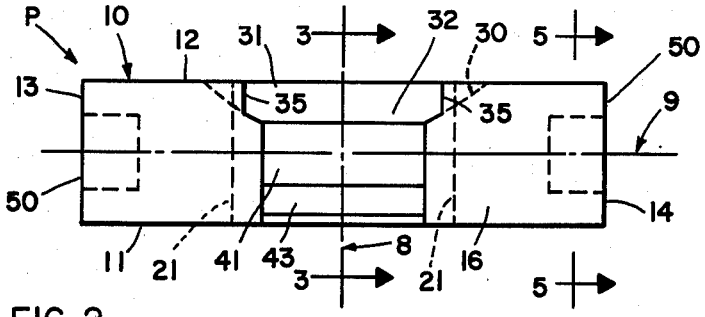
FIG. 2 is a forward elevational view of the FIG. 1 embodiment.
Figure 3:
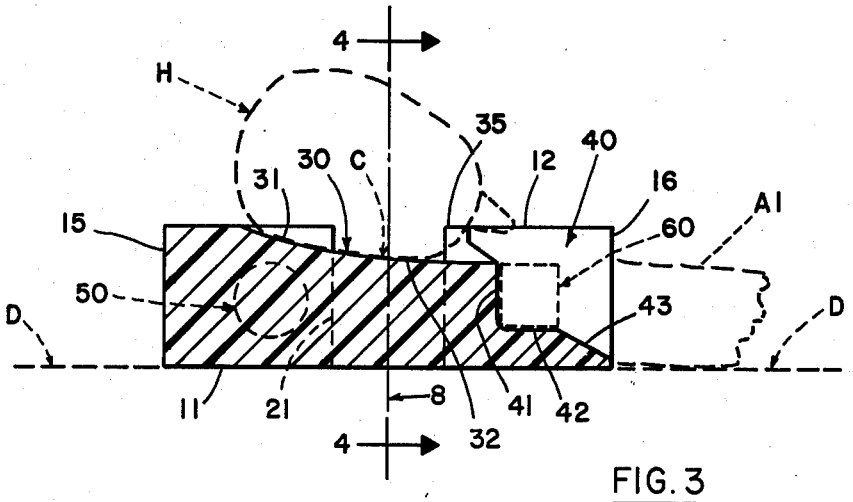
FIG. 3 is a sectional elevational view taken along lines 3—3 of FIGS. 1 and 2, the top end elevation of a hemiside reclining user being indicated in phantom line.
Figure 4:
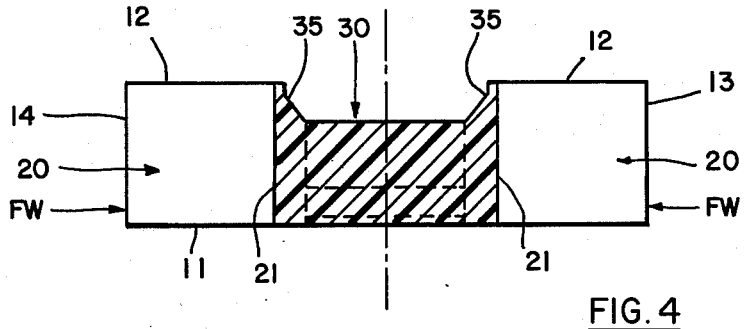
FIG. 4 is a sectional elevational view taken along lines 4—4 of FIGS. 1 and 3.

In FIGS. 1 and 3 of the drawing, a hemiside reclining user's anatomy is indicated in phantom line. Numbered anatomical features are as follows: the head in its entirety as "H"; a facial cheek as "C" of one of the symmetrical sides of head "H"; chin "CC"; spinal area "B"; shoulder "S"; and upper-arms "A2"(left) and "A2"(-right), "A1" being depicted hemiside lain upon.

Contoured security pillow "P" generally comprises a lofty pad 10 of resiliently compressible structural material, such as for example polyurethane foam, extending uprightly along vertical-axis 8 and extending lengthwise along longitudinal-axis 9. Pad 10 includes a bottom-side 11 and a top-side 12 both intersecting vertical-axis 8, bottom-side 11 being adapted to stably rest upon a suitable reclining substrate e.g. bed "D", and herein shown as horizontal and planar. There is a pair of longitudinally separated upright ends for pad 10 including a left-end 13 and a right-end 14 and herein being shown as vertically planar ends. The pad 10 also includes a pair of transversely separated upright sides including a rear-side 15 and a front-side 16; herein, rear-side 15 is vertically planar and extends continuously along rear-wing "RW" from left-end 13 to right-end 14.

As will hereinafter be explained in greater detail, the resiliently compressible pad e.g. 10, is provided with a plurality of special contours, two primary contours of the pillow "P" accommodating major anatomical features of the user. One of the primary pillow contours is the longitudinal channel (20) into which the user might lie parallel to longitudinal-axis 9 hemiside upon substrate "D" against a single upper-arm "A". It will be seen that one or two longitudinal channels 20 divides the pillow "P" into transversely separated rear-wing "RW" and front-wing "FW". The second primary pillow contour is the facerest depending from top-side 12 and surrounding vertical-axis 8 and against which the pillow user rests one of the symmetrical sides of his head "H". In such faceresting position, it is desireable to leave the forward vision of the user unobstructed, and in this vein, a frontal cutaway contour e.g. 40, is advantageous.

The facerest contour (30) should accommodate a single symmetrical side of the user's head so that the occipital backside is slightly higher than is the nasal frontside whereby, inter alia, the drainage of nasal and oral fluids is facilitated. Specifically, facerest contour 30 includes a higher elevation concave rear-contour 31 nearer the head occipital backside, portion 31 sloping gently downwardly toward and merging with a lower elevation front-contour portion 32 against which a facial cheek "C" rests. The user's nose might extend slightly forwardly of the facerest front-contour 32 into frontal cutaway 40 and above pan 60. The user's chin "CC" might be firmly restrained by upright-chin-restraint 35, located at channel leading-end 21 on front-wing "FW", which helps maintain the trachea straight. For the dual-directional pillow embodiment having two longitudinal channels 20, facerest contour 30 should be geometrically symmetric in both longitudinal directions of vertical-axis 8.

Longitudinally extending channel 20 has its trailing-end at a pad end (e.g. 13, 14) and extends therefrom along longitudinal-axis 9 for one-third to two-thirds the distance to vertical-axis 8 whereby the channel leading-end 21 is at facerest 30 and wings "FW" and "RW" afford anatomical support. Channel 20 throughout its longitudinal length necessarily extends through both top-side 12 and bottom-side 11. Accordingly, the downwardly extending clavicle located at the user's beneath upper-arm "A" might be positioned at channel leading-end 21 and with the user's chin "CC" adjacent thereto against upright chin-restraint protuberance 35. Desireably, there is a pair of like longitudinal channels 20 whereby the pillow "P" might be dualdirectional and employable for either one of the hemiside reclining positions. For example, as indicated in FIGS. 1 and 3, if the user wishes to hemiside recline against his rightward facial cheek and upper-arm, the rightward clavicle would be within that channel 20 nearer to pillow right-end 14. On the other hand, if the user wishes to hemiside recline in reverse direction against his leftward facial cheek and upper-arm "A2", the leftward clavicle would be within that channel 20 commencing from pillow left-end 13.

Figure 5:
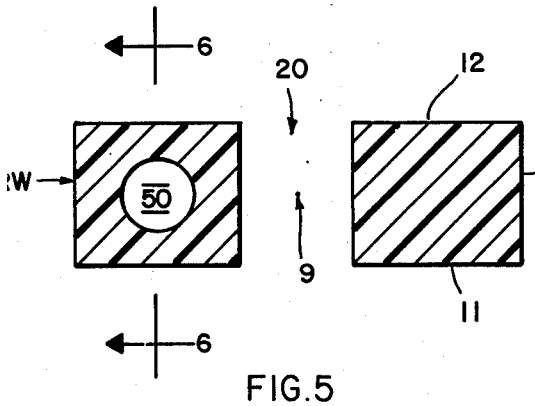
FIG. 5 is a sectional elevational view taken along line 5—5 of FIGS. 1 and 2.
Figure 5B:
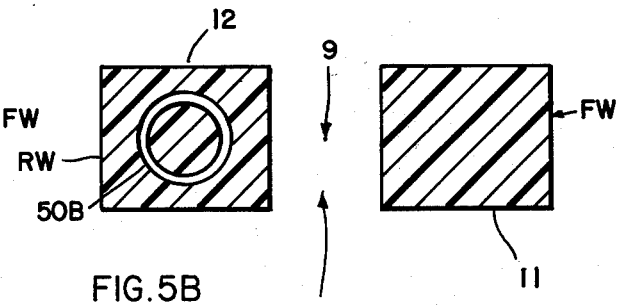
FIG. 5B is a sectional elevational view comparable to FIG. 5 but for yet another style endward-recess.
Figure 5A:
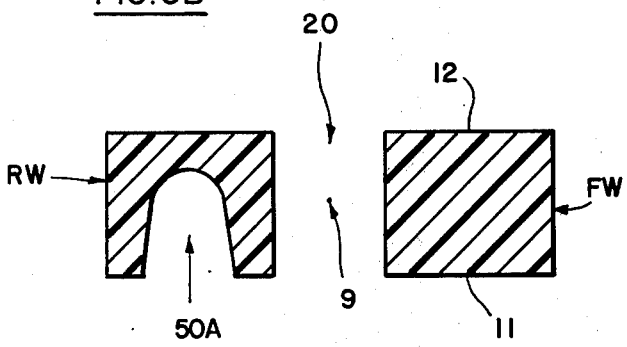
FIG. 5A is a sectional elevational view comparable to FIG. 5 but for an alternate style endward-recess.
Figure 6:
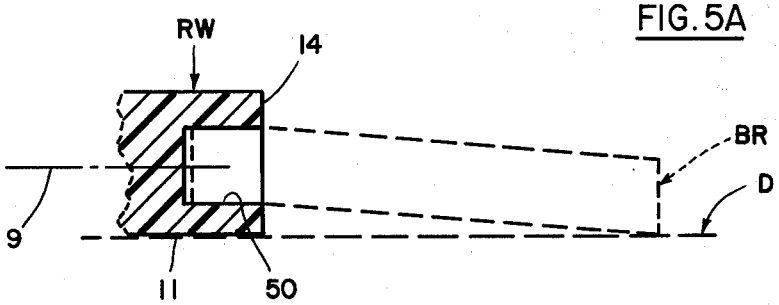
FIG. 6 is a sectional elevational view taken along lines 6—6 of FIGS. 1 and 5.

For certain situations, a hemiside reclining user of pillow "P" might require additional spinal backrest support e.g. "BR". Desireably, the supplemental backrest "BR" would be removably associated with and extending longitudinally from a rear-wing "RW" and alongside spinal area "B". In this vein, one or both of the pillow ends e.g. 13, 14, is provided with a longitudinally extending endward-recess 50 to removably accommodate the leadward vanguard portion of a supplemental backrest accessory e.g. "BR". In FIG. 5, the endward-recess 50 is of a circular bore shape to removably accommodate the vanguard of a cylindrical bolster backrest cushion "BR". In FIG. 5A, the endward-recess 50A is of parabolic cross-section for a similarly shaped backrest. The annular-groove endward-recess 50B of FIG. 5B would be appropriate for a semi-rigid circularly tubular supplemental backrest accessory.

As previously alluded to, frontal cutaway contour 40 commences at pad front-side 16 and extends transversely rearwardly therefrom to terminate at facerest front-contour 32. Also, cutaway 40 is recessed well downwardly of pad top-side 12 and has its floor 42–43 located in elevation below facerest 30–32 thereby leaving the user's frontal vision unobstructed. Pillow front-wings "FW" are located on opposite longitudinal sides of frontal cutaway 40. As indicated in phantom line in FIGS. 1 and 3, a collector pan 60 might be removably inserted within cutaway 40 to collect oral and nasal discharge fluids. Desireably, frontal cutaway 40 has a rearwall 41 extending abruptly downwardly of facerest part 32 and a horizontal floor part 42 for removably secureably accommodating collector pan 60. Moreover, the two ends of collector pan 60 might be removably frictionally secured by the pillow frontal wings "FW".

From the foregoing, the construction and use of the contoured security pillow will be readily understood and further explanation 4 is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. A contoured security pillow adapted to receive one shoulder and a symmetrical side of the head of a hemiside reclining person, said pillow comprising a resiliently compressible pad extending uprightly along a vertical-axis and lengthwise along a longitudinal-axis and said pad including: a top-side, a bottom-side intersecting said vertical axis and adapted to be stably superimposed upon a sleeping bed or similar reclining substrate, and a pair of longitudinally separated upright ends including a left-end and a right-end, and a pair of transversely separated upright sides including a front-side and a rear-side, said pad being provided with the following contours:

A. A facerest depending from the pad top-side and surrounding the pad vertical-axis, said facerest including a higher elevation rear-contour portion that slopes gently downwardly toward and merges with a lower front-contour portion;

B. At least one longitudinal channel to accommodate the reclining person's shoulder adjacent his downward facial cheek, said channel having its trailing-end at a pad end and an upright leading-end at the facerest and being located one-third to two-thirds the distance from said pad end to the vertical-axis thereof, said longitudinal channel throughout intersecting the pad top-side and bottom-side and thereby providing a pillow rear-wing and front-wing, said front-wing adjacent the channel leading-end including a chin-restraint portion extending uprightly adjacent the facerest front-contour; and C. A frontal cutaway commencing at the pad front-side and extending transversely rearwardly therefrom and terminating at the facerest front-contour, said frontal cutaway also extending through the pad top-side whereby the directionally forward vision of the hemiside reclining and faceresting pillow user is unobstructed by the pillow frontal parts.

2. The security pillow of claim 1 wherein there is a pair of said channels along the pad longitudinal-axis and a pair of said chin-restraints whereby a single pillow can accommodate a person who is hemiside reclining against either one of his upper-arms, the facerest contour and the channels contours being symmetrical about the pad vertical-axis.

3. The security pillow of claim 1 wherein the frontal cutaway has a floor located in elevation above the pad bottom-side and well below the facerest front-contour, the pad bottom-side lying along a horizontal plane.

4. The security pillow of claim 1 wherein the rear-wing commencing at a pad end is provided with an endward-recess substantially parallel to the longitudinal-axis and adapted to accommodate therewithin the vanguard part of a supplemental removable backrest for the hemiside reclining person.

5. The security pillow of claim 4 wherein the endward-recess is of annular groove shape to removably accommodate a semi-rigid tubular backrest.

6. The security pillow of claim 4 wherein the endward-recess is of non-annular cross-sectional shape to accommodate a solid backrest.

7. The security pillow of claim 6 wherein the endward-recess is a circular bore to accommodate a substantially cylindrically solid backrest accessory.

8. The security pillow of claim 2 wherein each rear-wing commencing at the pad ends is provided with a longitudinally extending endward-recess to removably accommodate the vanguard part of a supplemental backrest for a hemiside reclining person; and wherein the two channels collectively constitute at least one-half the pillow longitudinal length.

9. The security pillow of claim 3 wherein the frontal cutaway floor extends abruptly downwardly from the facerest front-contour and thence generally horizontally toward the pad front-side whereby a collector pan for nasal and oral discharge fluids might be removably positioned into the pillow frontal cutaway.

10. The security pillow of claim 2 wherein the entire pillow is symmetrical on both longitudinal sides of the vertical-axis; and wherein the frontal cutaway has a floor located in elevation above the pad bottom-side, said frontal cutaway being adapted to removably accommodate a collector pan for nasal and oral discharge fluids and frictionally secureable between the two front-wings.

11. The security pillow of claim 1 wherein at least one rear-wing commencing at the pad end is provided with an endward-recess adapted to accommodate therewithin a supplemental removable backrest for the hemiside reclining person.

* * * * *